United States Patent [19]

Weinz

[11] 4,002,017

[45] Jan. 11, 1977

[54] FRICTION MEMBER FOR A MISTWISTING APPARATUS

[76] Inventor: Ernst A. Weinz, Auf der Bilz 2, 6580 Idar-Oberstein 2, Germany

[22] Filed: June 23, 1975

[21] Appl. No.: 589,435

[30] Foreign Application Priority Data

June 28, 1974 Germany ..... 2431101

[52] U.S. Cl. ..... 57/77.4

[51] Int. Cl.[2] ..... D02G 1/08

[58] Field of Search ..... 57/77.3, 77.4, 77.45

[56] References Cited

UNITED STATES PATENTS

| | | | |
|---|---|---|---|
| 1,752,878 | 4/1930 | Ambye | 57/77.4 |
| 2,620,517 | 12/1952 | Schlums | 57/77.4 |
| 2,718,111 | 9/1955 | Brown | 57/77.4 |
| 3,777,467 | 12/1973 | Enneking | 57/77.4 |
| 3,845,613 | 11/1974 | Knebel | 57/77.4 |

*Primary Examiner*—Donald E. Watkins
*Attorney, Agent, or Firm*—Kinzer, Plyer, Dorn & McEachran

[57] ABSTRACT

This is concerned with a friction element for a false twisting apparatus for yarns, whereby a friction element consisting of a hard material has a longitudinal groovelike composition on the surface thereof extending parallel with the axis of rotation of the element.

7 Claims, 7 Drawing Figures

FRICTION MEMBER FOR A MISTWISTING APPARATUS

SUMMARY OF THE INVENTION

The invention relates to a friction element for a false twisting apparatus for the texturizing of yarns, whereby bushings, rings, disks, rods, belts and the like are provided for providing the twist, as friction elements.

False twisting devices are known where yarns of top quality are produced according to the false twisting method by means of slowly moving spindles and hooks and, further, with the aid of high speed spindles and thread guides, for example in the form of diabolos. Bushings, rings, disks, bars, belts and the like are used as friction elements, for example, which are driven with the aid of spindles, whereby in order to be twisted, the yarn adheres at the appropriate surfaces of the friction elements. The important disadvantage of these friction members according to prior art consists in providing an insufficient twist, so that turned spots occur due to slippage, the removal speeds and the number of twists per meter of the turns are limited and irregular.

An increase of the friction by rougher surfaces has failed in the elastic vulcollane and plastic materials used until now due to the high rate of wear of the material, producing yarns whose properties change during the lifetime of the friction members and thus cannot be mixed with each other during the processing. This, among other reasons, because the dye affinity of fabrics woven from such yarns varies. Experiments with such friction members, whereby they were replaced by hard materials, showed that here a technical limit is set when the friction between yarn and friction member is maintained so low, sufficient twisting is no longer imparted. If these materials were to be replaced by a rougher surface, broken filaments very easily are caused thereby leading to slubby yarn.

The invention is based on the problem of so designing such friction elements that the advantage of harder materials and thus a high service life can be used without having to accept the disadvantage of less friction or increased slub formation.

According to the invention this problem is solved in that in an element or member consisting of a hard material, for example oxide ceramic, saphire, glass, agate, spinell, carbides or the like, the surface in contact with the yarn has longitudinal grooves of high smoothness which extend parallel with the axis of rotation.

The longitudinal grooves advantageously have a cross section approximately semicircular in shape.

Another advantageous embodiment is characterized by the fact that in a member consisting of elastic rubber or synthetic masses or polyurethane formed bodies or small spherelets with a smooth surface of hard materials with high resistance to abrasion are embedded into the surface in contact with the yarn.

It is further advantageous for the formed bodies to be arranged in tiers parallel to the axis of rotation and/or radially.

The advantages reside particularly in the fact that the friction elements produced according to the invention have a long life and that the design and arrangement of the longitudinal grooves and/or of the molded bodies may be such that in function of the type of yarn and the properties of the yarn, the entrainment coefficient is adjustable in axial and tangential direction.

BRIEF DESCRIPTION OF THE DRAWINGS

The invention is explained more in detail in the following description by means of embodiments represented in the drawings.

DESCRIPTION OF THE PREFERRED EMBODIMENT

Figure 1:
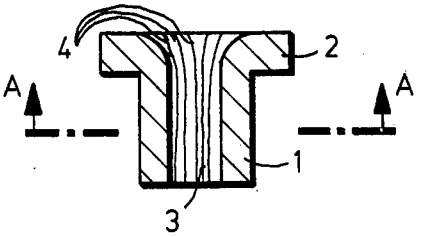
FIG. 1 is a longitudinal section through a bushinglike friction element.
Figure 2:
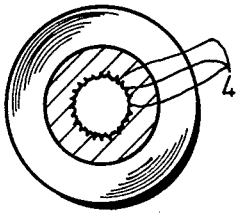
FIG. 2 is a cross section along line A—A of FIG. 1.

In the embodiment according to FIGS. 1 and 2, a bushing 1 is contemplated as a friction element having on the inside a perforation 3 flaring toward the collar 2, whereby said perforation 3 represents the surface in contact with the yarn. Longitudinal grooves 4 are arranged in this surface which extend parallel with the axis of rotation. These longitudinal grooves are designed semicircularly, for example, and arched toward the axis of rotation. Thus, the surface is so designed that a low friction coefficient is present in an axial direction, while in a direction tangential to the rotary movement, a high friction coefficient exists. The radius of these longitudinal grooves 4 may be 8 microns, for example.

Figure 3:
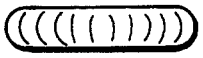
FIG. 3 is a friction element of disklike shape.
Figure 4:
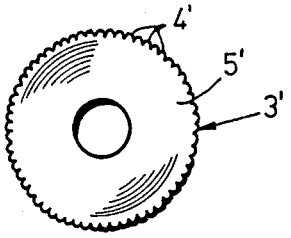
FIG. 4 is an end view of FIG. 3.

In the additional embodiment in FIGS. 3 and 4, a disk 5' is used as friction member with corresponding grooves 4' applied externally at the rounded disk body.

Here, too, these grooves 4' may be semicircular in design and terminate into each other, whereby, for example, a radius of about 8 microns may be provided. In this case the grooves 4' are arched externally, that is away from the axis of rotation. In both cases (FIGS. 1 to 4) the circular arches of the grooves 4' may be rounded at their points of intersection, that is they may altogether have a sine form.

In the embodiment according to FIGS. 1 to 4, the friction member is made of hard materials, for example agate, glass, ceramic, spinell, saphire, oxide ceramic, carbides or surface-coated materials, like steel with aluminum oxide coating, for example.

Figure 5:
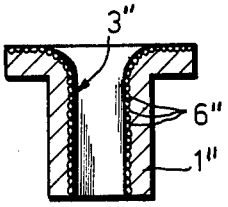
FIG. 5 is a cross section of another embodiment of a bushinglike friction member.
Figure 6:
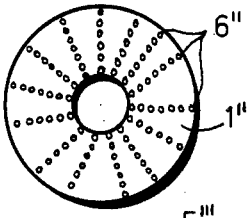
FIG. 6 is an end view of FIG. 5.

In order to utilize the advantages of an elastic polyurethane or of elastic rubber and plastic masses, it is possible, according to another embodiment shown in FIGS. 5 and 6, to embed into the surface 3'' in contact with the yarn molded bodies 6'' of hard materials according to the substances mentioned above, whereby these bodies are distributed linearly, that is in lines distributed parallel to the axis of rotation of the friction elements 1'' and then they extend radially. For example, balls may be embedded as such bodies 6'' with a diameter of 0.2 mm. The arrangement of these spherelets 6'' also may be such that varying entrainment coefficients are produced in axial and tangential direction, that is to say a static distribution takes place.

Figure 7:
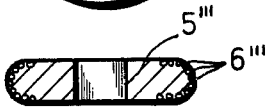
FIG. 7 is a cross section of a further embodiment.

In a dislike friction member 5'' according to FIG. 7 the bodies 6' are arranged externally at the circumference in tiers or randomly distributed.

While a preferred form and several variations have been set forth above, it should be understood that suitable additional modifications, changes, alterations and substitutions may be made without departing from the invention's fundamental theme.

The embodiments of the invention in which an exclusive property or privilege is claimed are defined as follows:

1. A friction element for use in a false twisting apparatus for the texturing of yarn, comprising a rotatable friction element in the form of an annulus having a curvilinear yarn-engaging surface, the surface having longitudinal grooves therein extending generally parallel to the axis of rotation of the friction member.

2. The structure of claim 1 further characterized in that the longitudinal grooves are generally semicircular in cross section.

3. The structure of claim 1 further characterized by and including small high wear-resistant balls embedded in the curvilinear yarn-engaging surface.

4. The structure of claim 3 further characterized in that the balls are arranged in tiers generally parallel to the axis of rotation of the friction member.

5. The structure of claim 1 further characterized in that the yarn-engaging surface is external.

6. The structure of claim 1 further characterized in that the yarn-engaging surface is internal.

7. The structure of claim 1 further characterized in that the longitudinal grooves in the yarn-engaging surface are semicircular in cross section and are arced toward the axis of rotation of the friction element.

* * * * *